US005687499A

United States Patent [19]

Brnjac

[11] Patent Number: 5,687,499

[45] Date of Patent: Nov. 18, 1997

[54] OVERHEAD ADVERTISING DISPLAY SYSTEM

[76] Inventor: Stephen Brnjac, 400 Bloor Street East, Unit 58, Mississauga, Ontario, Canada, L5A 3M8

[21] Appl. No.: 536,251

[22] Filed: Sep. 29, 1995

Related U.S. Application Data

[63] Continuation-in-part of Ser. No. 67,104, May 26, 1993, abandoned.

[51] Int. Cl.[6] ..... G09F 11/12

[52] U.S. Cl. ..... 40/524; 40/601

[58] Field of Search ..... 40/524, 526, 415, 40/446, 452, 466, 473, 472, 617, 601, 430; 248/323, 324, 327, 328; 403/180, 59; 472/6–12

[56] References Cited

U.S. PATENT DOCUMENTS

| | | | |
|---|---|---|---|
| 692,604 | 2/1902 | Bourke | 40/415 |
| 1,019,770 | 3/1912 | Doner . | |
| 1,528,005 | 3/1925 | Cannaday | 248/323 X |
| 2,036,147 | 3/1936 | Klema . | |
| 2,181,021 | 11/1939 | Lockwood et al. . | |
| 2,978,217 | 4/1961 | Gunderson | 403/59 X |
| 3,031,784 | 5/1962 | Stein | 40/473 |
| 3,281,906 | 11/1966 | Rakel | 403/180 X |
| 3,676,942 | 7/1972 | Elrod | 40/617 X |
| 3,735,513 | 5/1973 | Constant, Jr. et al. | 40/472 |
| 3,736,417 | 5/1973 | Williams | 248/323 X |
| 3,781,047 | 12/1973 | Surko, Jr. | 403/59 X |
| 3,972,140 | 8/1976 | Casparro . | |
| 4,970,812 | 11/1990 | Tanaka et al. | 40/452 |
| 5,181,334 | 1/1993 | Mima | 40/524 |
| 5,405,117 | 4/1995 | Davis | 248/323 X |

FOREIGN PATENT DOCUMENTS

| | | | |
|---|---|---|---|
| 508462 | 12/1954 | Canada | 40/524 |
| 2636222 | 3/1990 | France | 40/430 |
| 2074770 | 11/1981 | United Kingdom | 40/430 |

*Primary Examiner*—Joanne Silbermann
*Attorney, Agent, or Firm*—Eugene J. A. Gierczak

[57] ABSTRACT

This invention relates to a dynamic display system which includes an endless display path which is secured to the ceiling of a building, advertising displays which depend from and move along the display path, and a driving mechanism for driving the advertising displays along said display path and a security video camera could be incorporated in the display.

9 Claims, 12 Drawing Sheets

OVERHEAD ADVERTISING DISPLAY SYSTEM

This is a continuation-in-part of application Ser. No. 08/067,104, filed May 26, 1993, now abandoned.

FIELD OF INVENTION

This invention relates to a dynamic display system which includes an endless display path, advertising displays which depend from and move along the display path, and a drive mechanism for driving the advertising displays along the advertising display path and a security camera could be incorporated within this system.

BACKGROUND OF THE INVENTION

Advertising has been and is being utilized by most businesses and individuals to promote the sale of their goods and services. Such advertising takes many forms which includes the print media, radio and television medias.

Many stores include advertising signs which are stationary. There have however, been some attempts at producing dynamic advertising display systems.

For example U.S. Pat. No. 3,972,140 features a portable dynamic advertising display system which includes an endless display path formed by an assembly of communicating track sections and adjustable supports to carry the display path. A plurality of advertising signs are dependently carried below the display path by roller assemblies carried along the guide rail disposed within the display path. The roller assemblies are connected to and carried on an endless drive belt.

Moreover, U.S. Pat. No. 2,181,021 relates to a display apparatus having a carrier provided with means for movably supporting articles to be displayed and provided with means for a moveable supporting sign to be displayed.

Yet another arrangement is shown in U.S. Pat. No. 5,181,334 which relates to a display apparatus which has an endless drive member wound on drive sprockets and driven sprockets so that the drive member travels along a circulating travel path.

Other arrangements are shown in U.S. Pat. Nos. 1,019,770 and 2,036,147.

These and other prior art advertising systems are inefficient and not well-suited to provide dynamic advertising display systems to be utilized by stores.

It is an object of this invention to provide a more efficient and useful dynamic advertising display system.

A dynamic display system comprising: an endless display path display means depending from said display path; drive means for continuously driving said display means along said display path, said display means continuously secured to said drive means for continuous movement of said display means along said display path.

A dynamic display system secured to a ceiling comprising: an endless display path defining a plurality of communicating advertising display paths; advertising display means depending from said endless display path; connecting means for connecting said advertising display means to said endless display path; drive means for continuously driving said advertising display means along said endless display path, said advertising display means continuously secured to said drive means for continuous movement and unobstructed visibility of said display means along said endless display path; switching means for controlling and switching the movement of said advertising display means along said plurality of advertising display paths; control means for controlling the movement of said advertising display means along said plurality of said advertising display paths.

DESCRIPTION OF THE DRAWINGS

These and other objects and features of the invention shall now be described in relation to the following drawings.

DESCRIPTION OF THE INVENTION

Like parts have been given like numbers throughout the figures.

Figure 1:
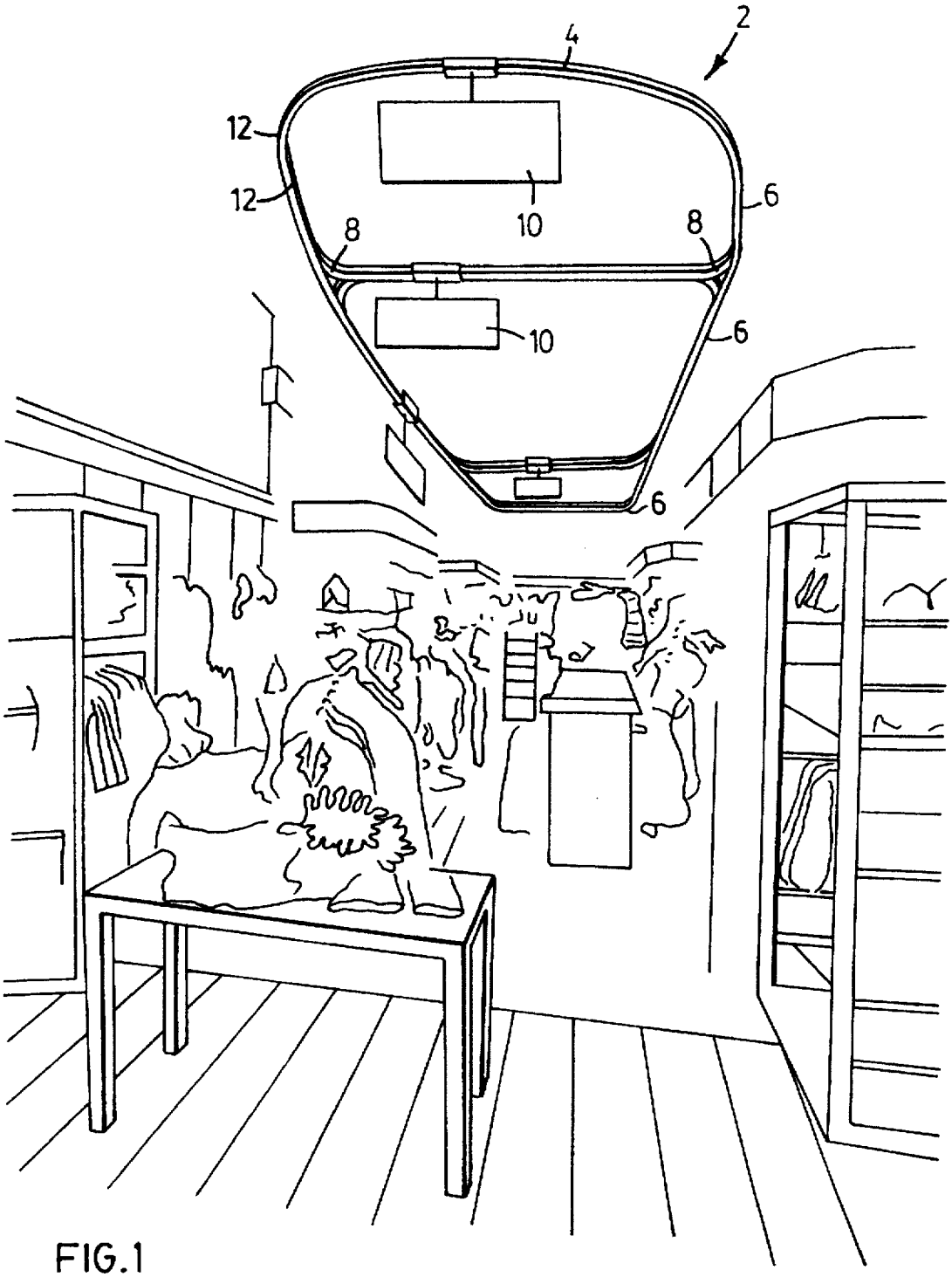
FIG. 1 is a perspective view of the advertising display system.
Figure 2:
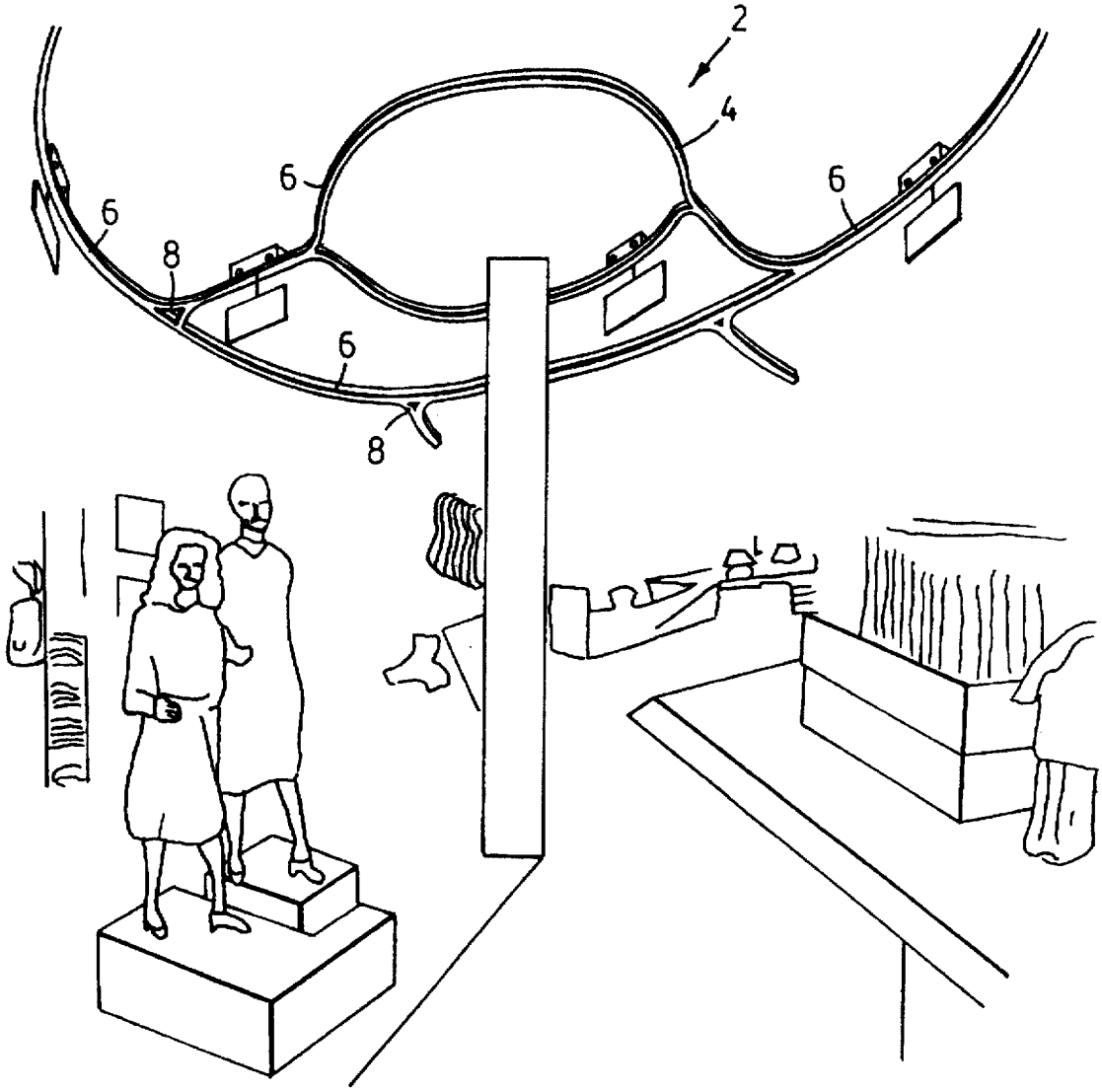
FIG. 2 is a second perspective view of the advertising display system.

FIGS. 1 and 2 are illustrative of the advertising display system 2 which includes a display path 4 defining a plurality of advertising display paths 6. In particular, the display 2 is secured to a ceiling of a building as best illustrated in FIGS. 1 and 2. The display path 2 is secured to the ceiling or the like by a variety of any fastening means (not shown) which include screws, clamps or the like.

The advertising display system 2 also includes switching means 8 which permit the advertising displays 10 to switch from one of the advertising display paths 6 to another advertising display path 6 in the manner to be more fully described herein. The advertising display system 2 also includes display means 10 which can comprise of a number of different means such as cards which include advertising messages thereon, monitors such as television sets, or programmable LED displays which are adapted to show advertising which has been programmed therein by a computer or the like.

The display means 10 are adapted to move along the display path 4 and in particular to move from one of the advertising display paths 6 to the other by means of activating the switches 8.

Figure 4:
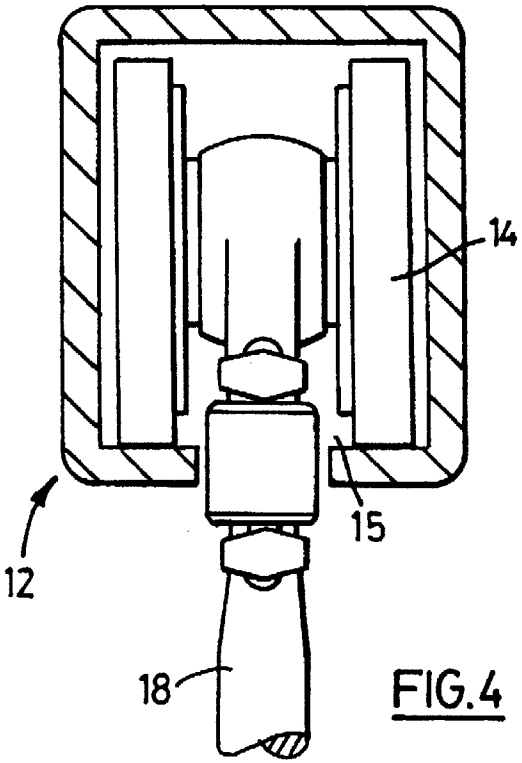
FIG. 4 is a cross-sectional view of one particular embodiment of the advertising display path.

In particular the endless display path 4 and also the plurality of communicating advertising display paths 6 comprise a plurality of communicating track sections 12. A typical cross-section through a track section 12 is shown in FIG. 4 and includes wheels 14 which are adapted to ride within the interior channel 15 section of the track 12 as well as a connecting rod 18 adapted to be secured to the advertising display 10.

Figure 13:
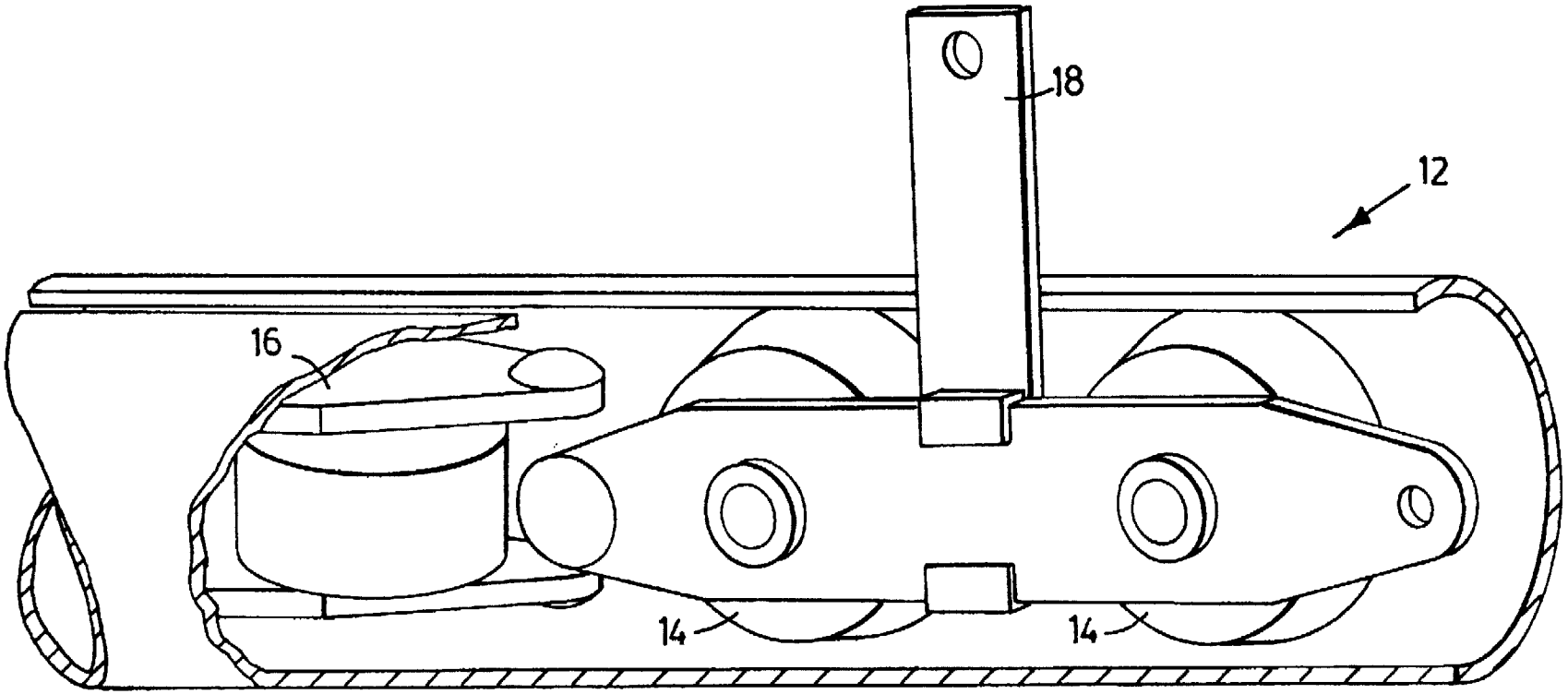
FIG. 13 is another side elevational view of another embodiment of the track of the track section.
Figure 14:
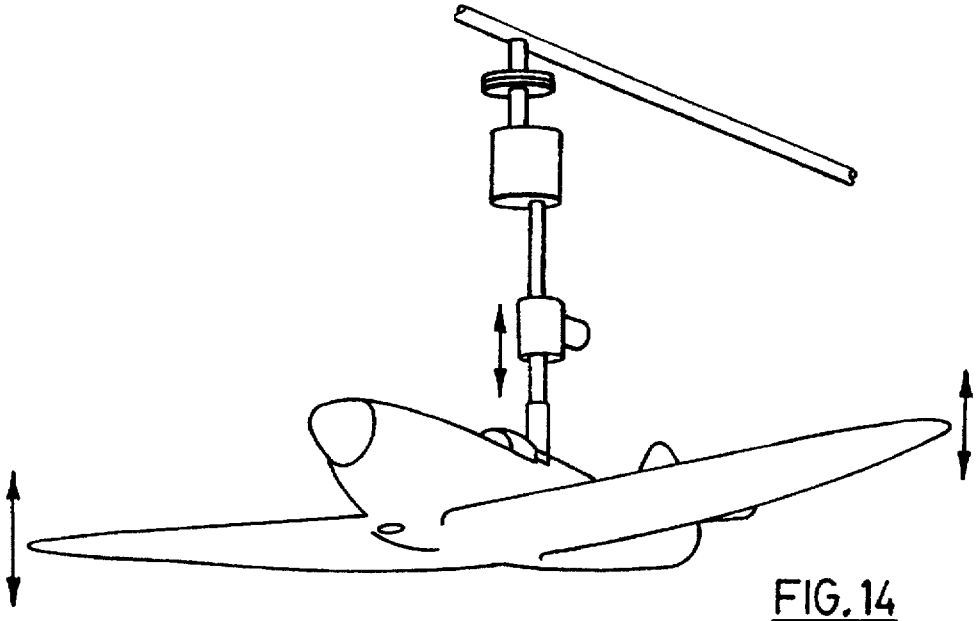
FIG. 14 is side elevational view of the advertising system showing the up and down motion.
Figure 15:
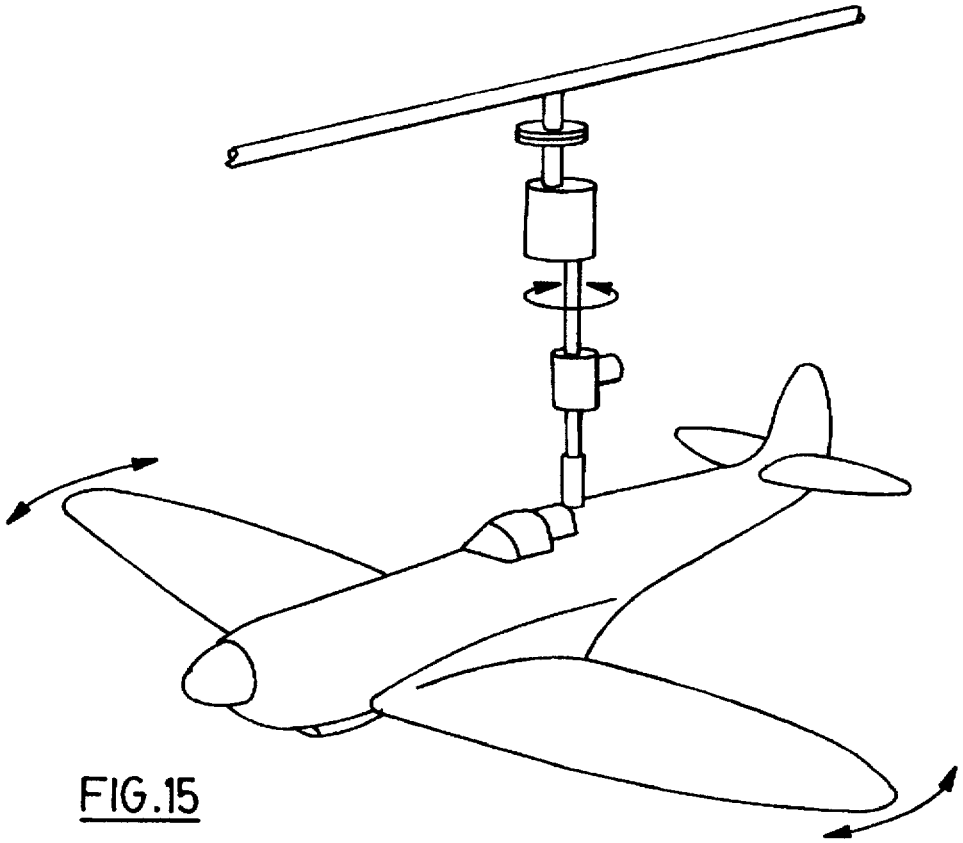
FIG. 15 is a side elevational view showing the rotation motion.
Figure 16:
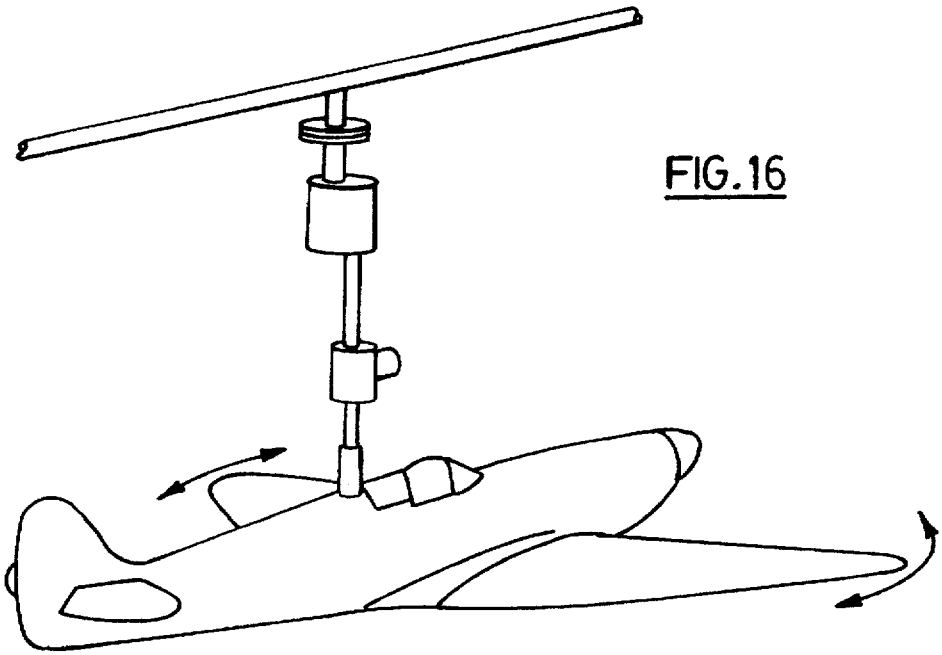
FIG. 16 is a side elevational view showing the turning motion.
Figure 17:
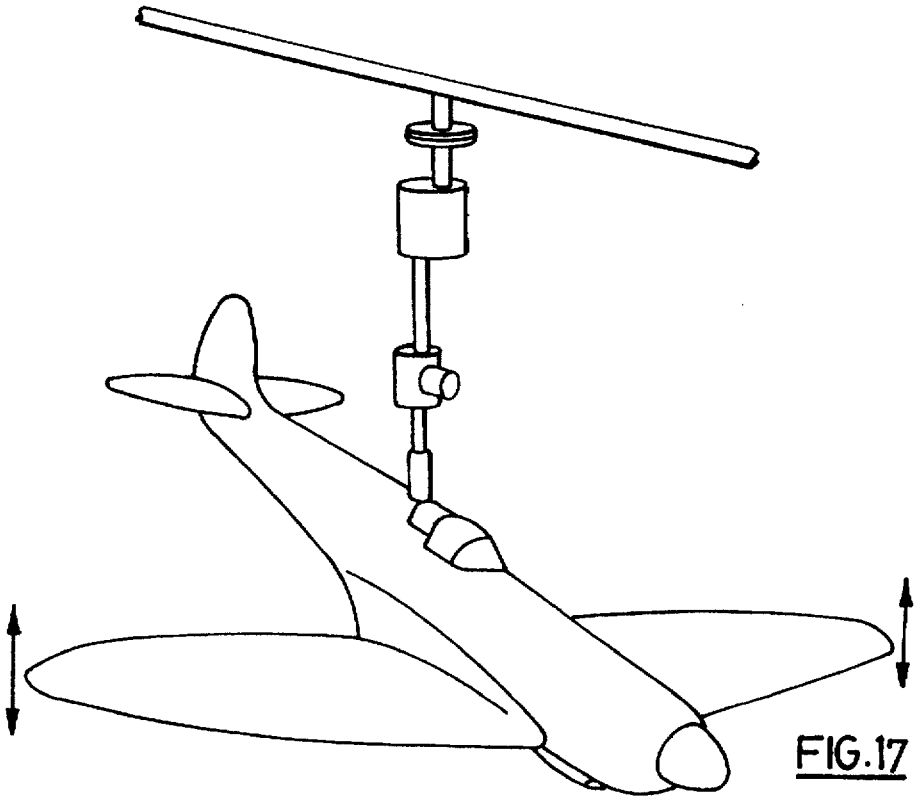
FIG. 17 is a side elevational view showing the up and down pivoting about a universal ball and socket joint.

Another embodiment of the track section 12 is shown in FIG. 13 which illustrates the wheels 14 adapted to ride inside the track section 12. FIG. 13 also illustrates the use of an endless chain link 16 which is adapted to be moved by a driving mechanism to be described herein so as to cause the connecting rod 18 and therefore the advertising display 10 to move along the endless display path 4 so as to catch the eye of a person within the store.

Figure 3:
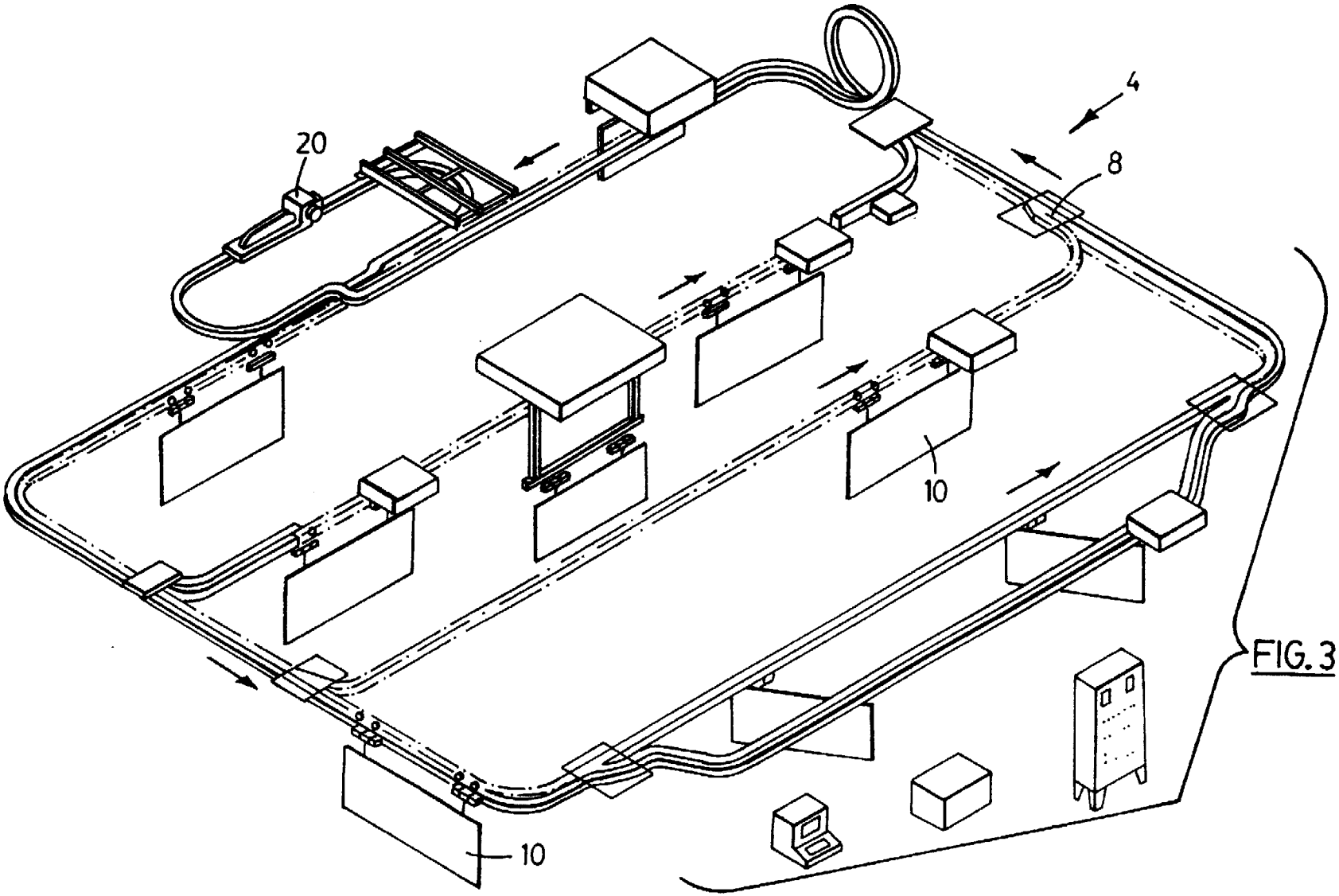
FIG. 3 is another perspective view of the advertising display path.
Figure 5:
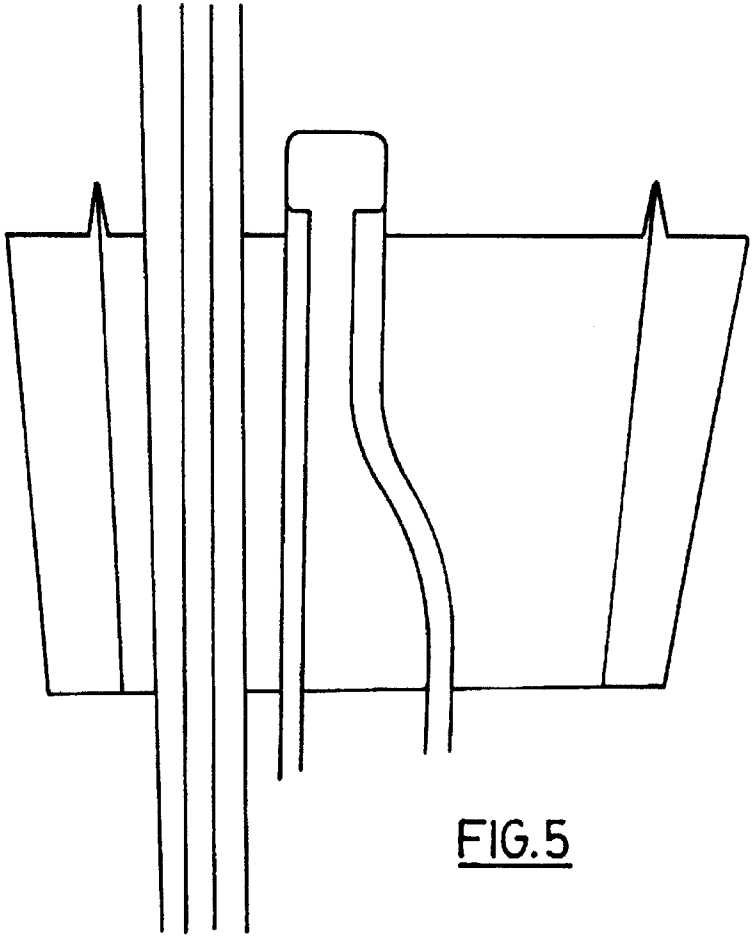
FIG. 5 is a perspective view of one embodiment of the switching mechanism

FIG. 3 is another example of an endless display path 4 showing switching means 8 advertising displays 10 which are caused to move along the display path 4 by a driving mechanism 20 which can include a motor or the like. The motor 20 would be connected to a chain link 16 in a manner well-known to those persons skilled in the art and would activate the chain link 16 so as to cause the chain link 16 to move within the track sections 12 thereby moving the wheels 14 and connecting rod 18 so as to cause the advertising display unit 10 to move along the advertising display path 4.

Figure 6:
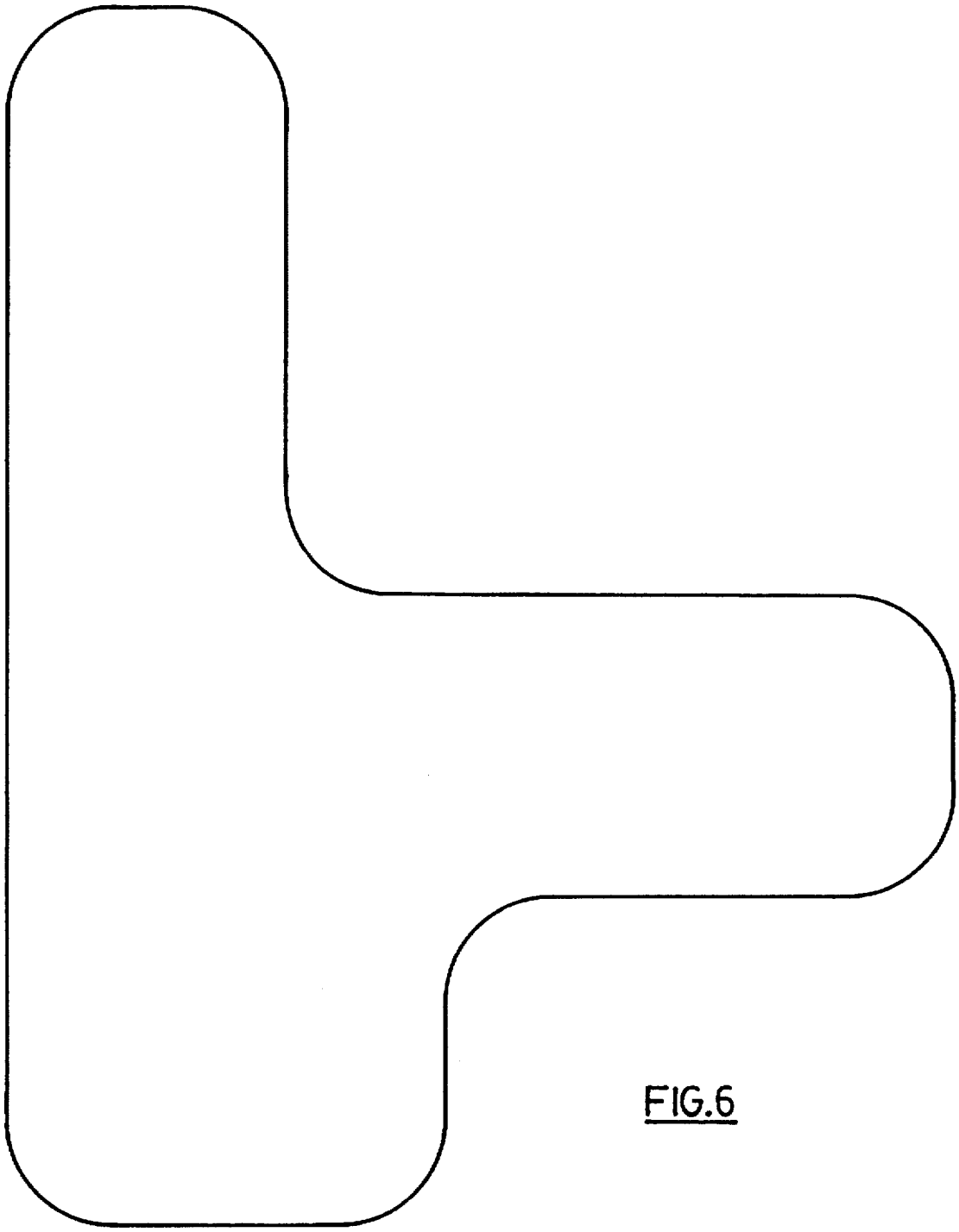
FIG. 6 is a plan view of one embodiment of the advertising display path.

FIG. 6 is a plan view of an example of the endless shapes the display paths 4 could take once installed in a retail store or public walkway. The shape of the display paths 4 are continuous with no start or finish and are well-suited to continuous belt, chain or link systems that already exist and are well-known to those persons skilled in the art.

Figure 7:
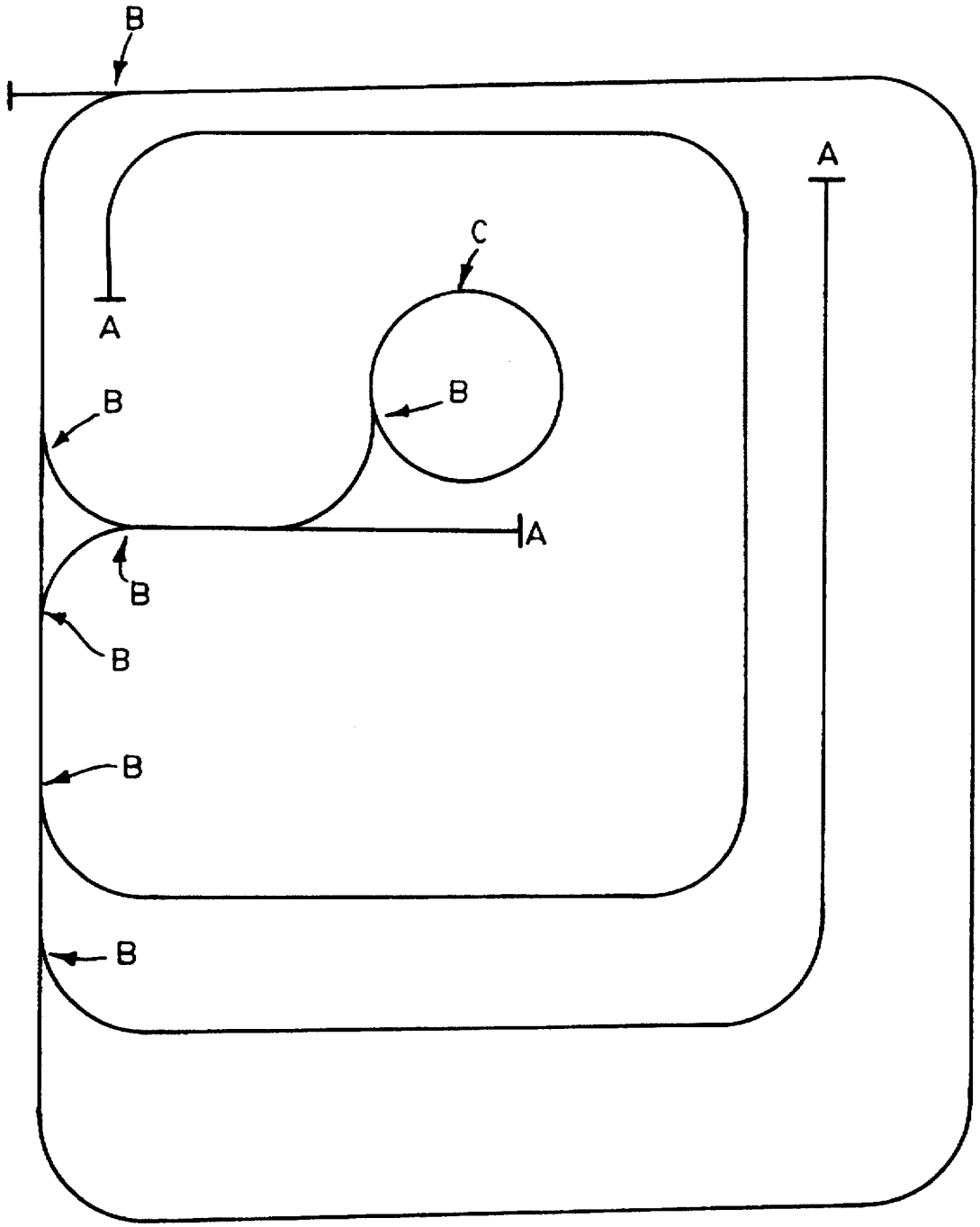
FIG. 7 is a plan view of another embodiment of the advertising display path.

More complex display paths 4 can be constructed by employing self-powered display carrying devices that are controlled by central computers so as to build advertising display paths as shown in FIG. 7.

The dynamic display system 4 shown in FIG. 7 include terminations marked "A" as well as junctions at points marked by "B". Continuous circles "C" can be constructed which are adapted to receive self-powered trolleys to be more fully described herein which trolleys can travel around the circle "C" a pre-programmed number of times before the trolleys are switched to the other advertising display paths.

Since the trolleys to be described herein can be self-powered and controlled by a computer, each trolley can take a complex route on the track system in one direction or change directions throughout its program course which could occur for example when the trolley reaches a termination marked "A". Moreover, the trolley can be adapted to change speeds or stop for a brief programmed amount of time throughout its programmed routine.

Each trolley can include a simple advertising sign that could turn and possibly move up and down vertically while the trolley travels along the track so as to further enhance the visibility of the advertising sign. Moreover while the trolleys travel around the track system 4, each trolley can include a different advertising display sign as shown, for example, in FIG. 8.

Figure 8:
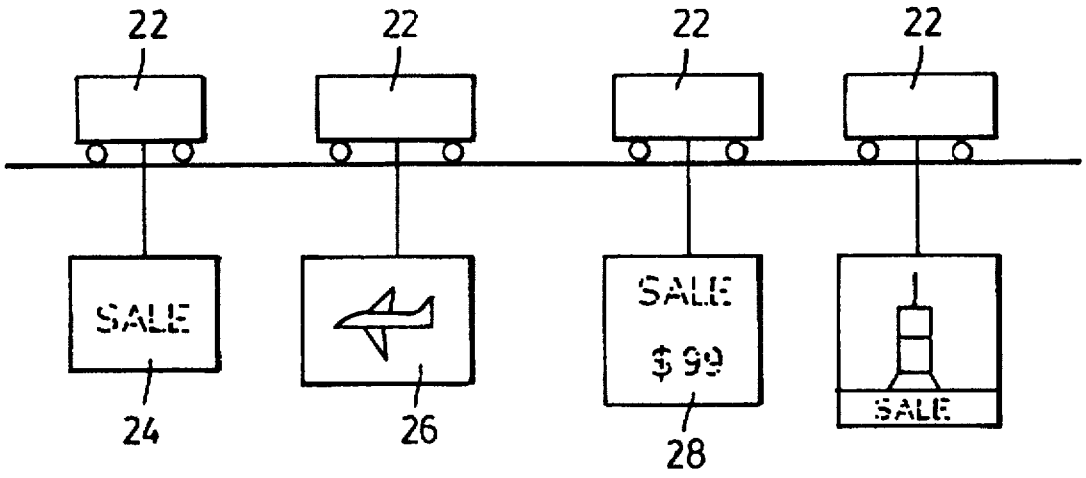
FIG. 8 is a side-elevational view of the advertising display path.

In particular FIG. 8 illustrates that the trolley 22 can include a simple advertising sign that can be adapted to turn slowly and move up and down vertically. Moreover, the trolleys 22 can include video displays 26 or LED displays 28. Moreover the trolleys 22 could be adapted to actually display the particular article on sale.

Figure 9:
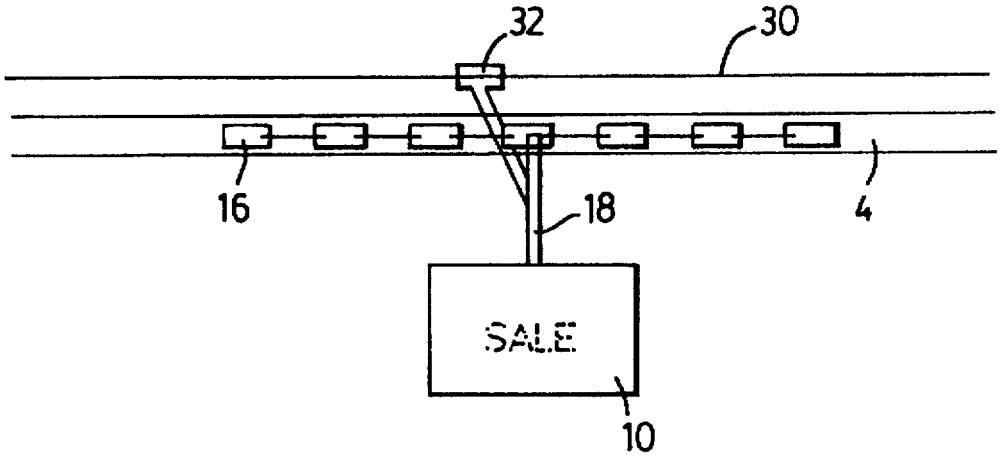
FIG. 9 is a cross-sectional view of another embodiment of the advertising display system.

FIG. 9 illustrates a particular embodiment of the invention where the connecting rod 18 is attached at one end to the advertising display 10 and at the other end thereof to a chain 16 which is moved by the motor 20. A power rail 30 is associated with the display path 4 so as to provide power to a pick-up 32 whereby the pick-up 32 would be adapted to pick-up signals (such as radio signals) so as to read, display or change the display on the advertising display 10 which could consist of a video 26. In the arrangement shown on FIG. 9, the video display 26 could take the same route.

Figure 10:
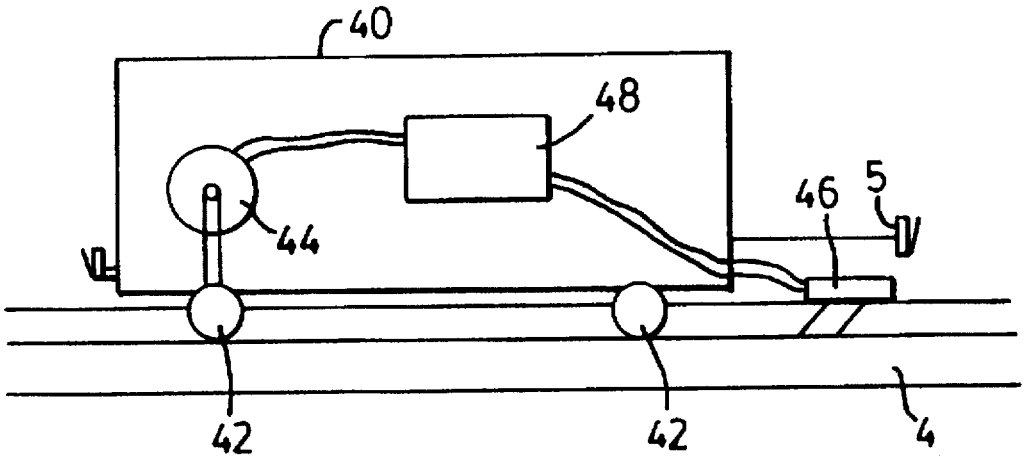
FIG. 10 is a partial cross-sectional view of the motorized trolley with logic.

Another embodiment of the invention is shown in FIG. 10 which consists of a trolley 40 having wheels 42 adapted to ride along the display path 4. The trolley 40 includes a motor 44 for moving the wheels 42 by a pulley or other means 46. In the embodiment shown in FIG. 10 the display path 4 would include a power rail adapted to contact a power and command pick-up module 46. In particular the power and command pick-up module 46 is designed to provide power to the motor 44 so as to move the wheels 42 as well as to pick-up the command signals which would be processed by a logic-powered driver board 48 in a manner well-known to persons skilled in the art. In particular, the motorized trolley with logic 40 is controlled by a computer (not shown) so that the motorized trolley with logic 40 would be capable of all of the functions shown in FIG. 9 but could change speed and direction as well as stop at pre-programmed points or time intervals.

Figure 11:
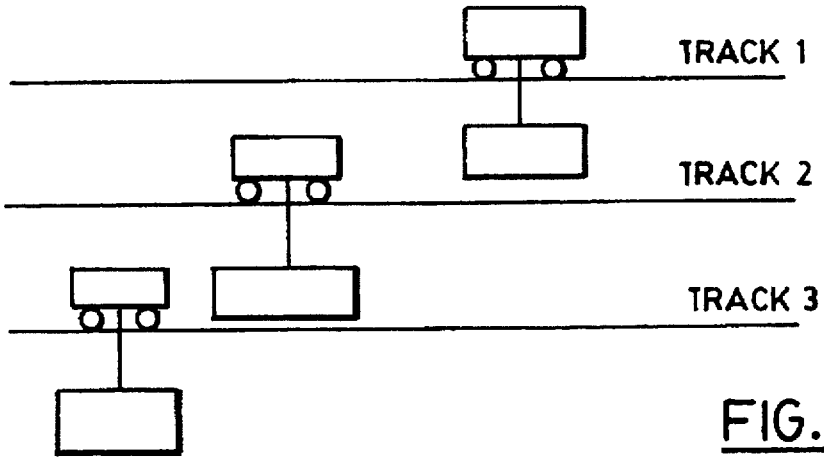
FIG. 11 is a further side-elevational view showing the tracks.

Moreover, the motorized trolley with logic 40 is adapted to be independent of any other trolley 40 which would be used on the display path 4. Accordingly, if the position and speed of each of the trolleys at some points in their routes were synchronized, the display, potential and effect could be even greater as for example, illustrated in FIG. 11.

Figure 12:
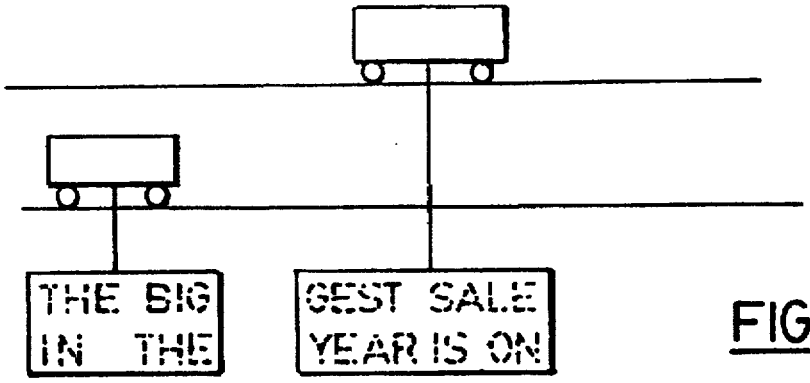
FIG. 12 is another side-elevational view of a further embodiment of the invention.

Moreover FIG. 12 shows that the advertising displays 10 of each of the trolleys 40 could be combined so as to provide a single message. The track systems described above are illustrative of the systems which can be designed from existing manufacturers. In particular, the track systems can be constructed from track systems sold by Rapistan Demag Corporation in Grand Rapids, Mich., or from Richards-Wilcox in Aurora, Ill. as well as White Conveyors Inc. having an office in Kenilworth, N.J. These track systems, as well as others, can be adapted so as to construct the dynamic display systems described herein.

In particular, it should be noted that the dynamic display system used herein is highly visible and will attract the attention of shoppers within the building. Although static advertising signs are effective in advertising, moving objects tend to attract the eye of an individual and accordingly will enhance the advertising effect in a store. Moreover the dynamic advertising display systems could be constructed so as to provide a track system which is partially within the store as well as outside the store as, for example, in the mall or the like. Such arrangements could therefore attract the attention of shoppers within the mall so as to lead such shopper into a particular store.

Accordingly by utilizing the dynamic advertising display system 2 described herein, such system would attract attention through the use of dynamically moved advertising display signs, or televisions. Moreover, computers can be utilized to control the advertising display units 10 as well as quickly and efficiently change advertising signs on television monitors or LED monitors or the like. Furthermore, the computers can be utilized to move the advertising display units 10 either up or down or to rotate therearound so as to further enhance the visibility of same.

Moreover, the signs on the advertising display units 10 can be changed by use of a computer and radio signals which will change the signs to be displayed thereon.

Furthermore, in an alternative embodiment, security cameras can be substituted for the advertising display system 2 so as to provide a dynamic security system.

Figure 18:
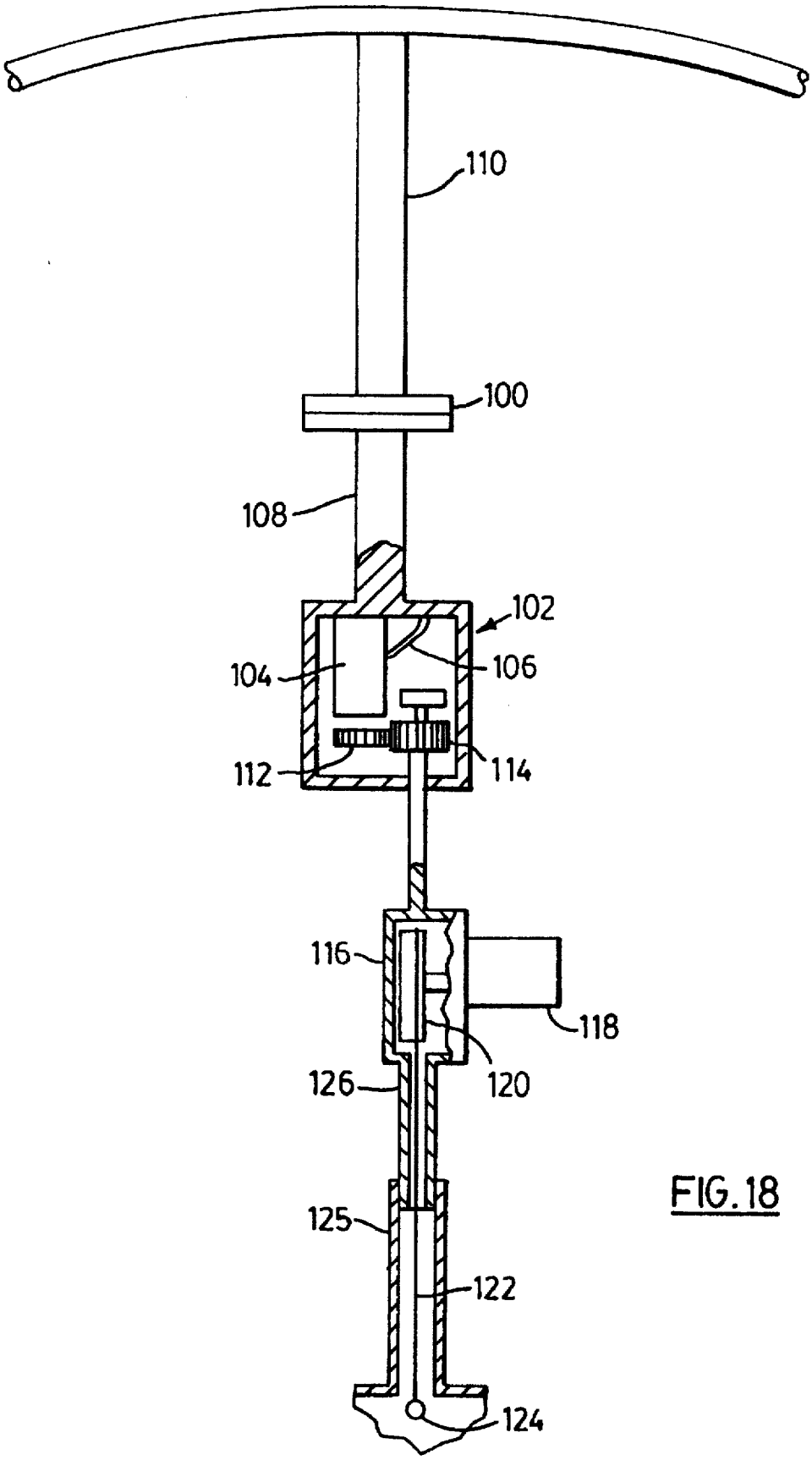
FIG. 18 is a cross-sectional view of the mechanism for the up and down motion.

FIG. 18 is a cross-sectional view of the mechanism for the up and down motion. In particular, 100 is a universal mount. Numeral 102 is a housing which encloses an electric motor 104 with suitable wiring 106 that is disposed within conduits 108 and 110 for powering the electric motor 104. Electric motor 104 includes a drive gear 112 which engages with gear 114 to rotate the display 10. FIG. 18 also discloses a further housing 116 which includes an electric pulley drive motor 118 that drives pulley 120. Pulley 120 is connected to cable 122 that is attached to a ball and socket joint 124 that is connected to display 10. A large diameter steel tube 125 is connected to the ball and socket joint. A smaller diameter tube 126 fits into the larger diameter tube 124 125 to permit a telescoping action as the cable is winched up and down the pulley.

Although the preferred embodiment as well as the operation and use have been specifically described in relation to the drawings, it should be understood that variations in the preferred embodiments could be achieved by a man skilled in the art without departing from the spirit of the invention. Accordingly the invention should not be understood to be limited to the exact form revealed by the drawings.

I claim:

1. A dynamic advertising display system comprising:

(a) an endless display path secured to a ceiling;

(b) display means depending from said display path;

(c) connecting means extending vertically downwardly from said endless display path for connecting said advertising display means to said endless display path;

(d) drive means for continuously driving said display means along said display path, said display means continuously secured to said drive means for continuous movement of said display means along said display path;

(e) said connecting means including drive gear means for rotating said advertising display means about a vertical axis, and pulley drive means for vertically moving said advertising display means.

2. A dynamic display system as claimed in claim 1 wherein said display means comprises advertising signs.

3. A dynamic display system as claimed in claim 1 wherein said display means comprises a monitor for advertising.

4. A dynamic display system as claimed in claim 3 wherein said monitor comprises a television monitor.

5. A dynamic display system as claimed in claim 4 wherein said endless display path comprises a plurality of communicating track sections.

6. A dynamic display system as claimed in claim 3 wherein said monitor comprises an LED screen.

7. A dynamic advertising display system secured to a ceiling comprising:

(a) an endless display path defining a plurality of communicating advertising display paths;

(b) connecting means extending vertically downwardly from said endless display path for connecting said advertising display means to said endless display path;

(c) drive means for continuously driving said advertising display means along said endless display path, said advertising display means continuously secured to said drive means for continuous movement and unobstructed visibility of said display means along said endless display path;

(d) switching means for controlling and switching the movement of said advertising display means along said plurality of advertising display paths;

(e) control means for controlling the movement of said advertising display means along said plurality of said advertising display paths;

(f) said connecting means including drive gear means for rotating said advertising display means about a vertical axis, and pulley drive means for vertically moving said advertising display means.

8. A dynamic advertising display system as claimed in claim 7 wherein said connecting means includes:

(a) a conduit depending vertically downwardly from said endless display path;

(b) a first housing for housing said drive gear means;

(c) a second housing for housing said pulley drive means;

(d) telescoping tubes connected to said second housing and said advertising display means; and (e) a cable connected to said advertising display means and driven by said pulley drive means for vertically moving said advertising display means up and down.

9. A dynamic advertising display system as claimed in claim 8 wherein said telescoping tubes, includes a ball and socket connection for connection to said advertising display means.

* * * * *